US005784948A

United States Patent [19]

Chrestoff et al.

[11] Patent Number: 5,784,948

[45] Date of Patent: Jul. 28, 1998

[54] POSITIVE DISPLACEMENT PUMP HAVING LEVITATING MAGNETIC PISTON SPRING CIRCUIT

[75] Inventors: Brian M. Chrestoff, Sidney, Ohio; Robert H. Ash, Jr., Humble, Tex.

[73] Assignee: FMC Corporation, Chicago, Ill.

[21] Appl. No.: 912,743

[22] Filed: Aug. 18, 1997

[51] Int. Cl.[6] ..... F01B 13/04; F04B 1/12

[52] U.S. Cl. ..... 92/57; 92/71; 92/130 B; 417/269

[58] Field of Search ..... 92/12.2, 57, 71, 92/130 B, 135; 417/222.1, 269

[56] References Cited

U.S. PATENT DOCUMENTS 4,355,959 10/1982 Kono et al. ..... 417/223
4,480,961 11/1984 Kono et al. ..... 417/269 X
4,783,609 11/1988 Sugiyama et al. ..... 417/222.1 X
5,100,301 3/1992 Hidaka et al. ..... 417/269 X
5,391,058 2/1995 Goto et al. ..... 417/269 X
5,407,328 4/1995 Kimura et al. ..... 417/269 X

*Primary Examiner*—Hoang Nguyen
*Attorney, Agent, or Firm*—Henry C. Query, Jr.

[57] ABSTRACT

A positive displacement pump including a plurality of pistons reciprocally driven in respective cylinders by a swashplate assembly to expel fluid during the pressure stroke of the piston from a chamber in communication with each piston. Oppositely disposed magnets are located respectively in an upper pressure face of each piston and in a check valve housing adjacent each cylinder to produce a magnetic force circuit accelerating movement of each piston toward and in continual contact with a cluster bearing associated with the swashplate assembly during the suction stroke of each piston. Like poles of each magnet face each other to produce a permanent levitating force on each piston.

6 Claims, 1 Drawing Sheet

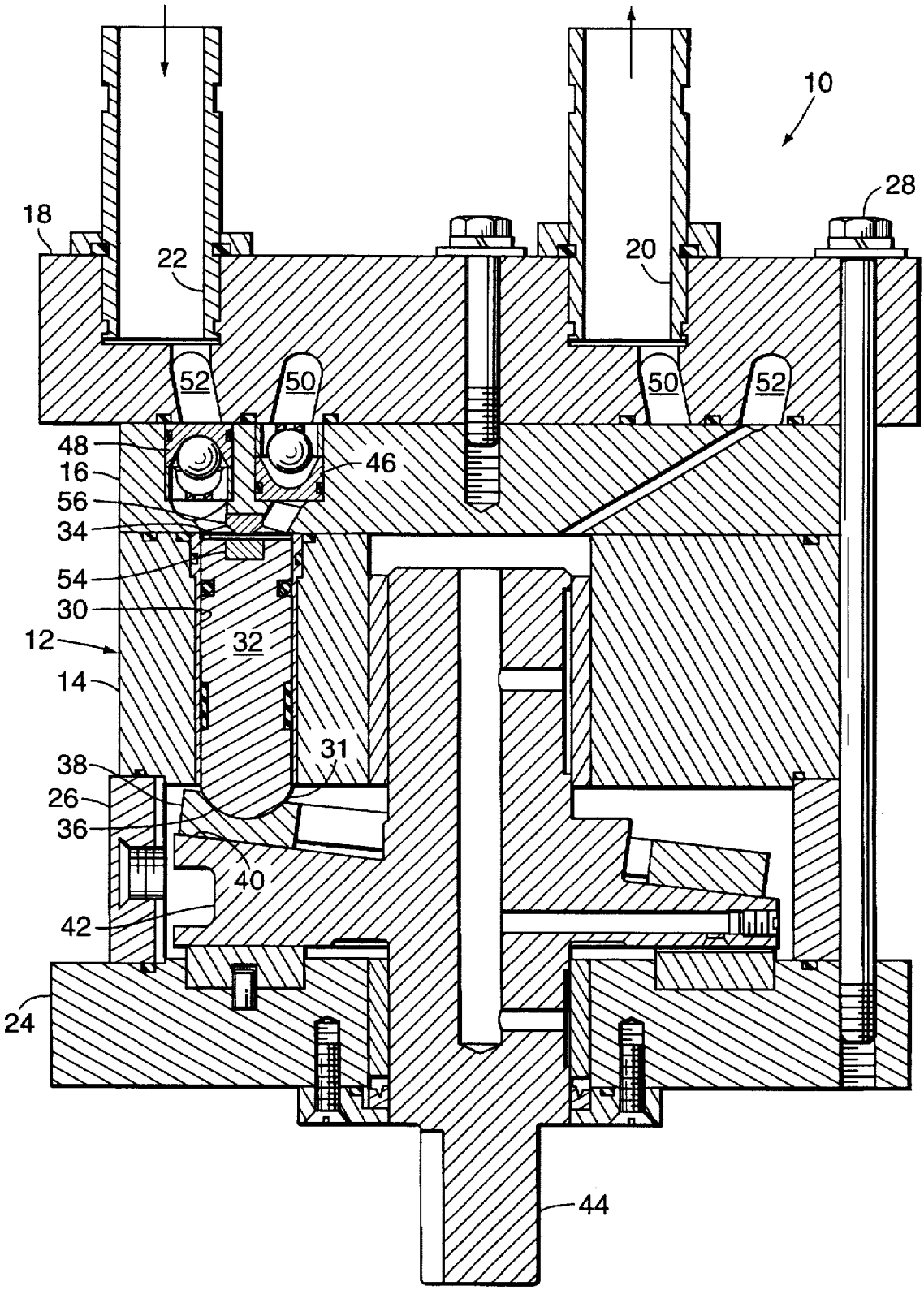
10
28
18
22
20
52
50
50
52
48
16
46
56
34
54
30
12
32
14
31
38
26
36
40
42
24
44

POSITIVE DISPLACEMENT PUMP HAVING LEVITATING MAGNETIC PISTON SPRING CIRCUIT

BACKGROUND OF THE INVENTION

The present invention relates to a positive-displacement swashplate piston pump, and more particularly to such a pump having a levitating magnetic piston spring circuit for urging the pistons into contact with the swashplate during their suction stroke.

High-pressure positive-displacement swashplate piston pumps are capable of continuous operation at high speeds and high pressures. These pumps typically comprise a number of fluid pumping pistons which are reciprocated by a swashplate having a cam surface, which contacts a cluster bearing having a number of recesses for receiving each piston. However, difficulty arises in maintaining contact between the piston and the cam surface during the suction stroke of the piston. At high speeds, continuous unbroken contact of the piston against the retreating face of the cam during the suction stroke is essential to smooth pump operation, maximum pump component life, and optimum volumetric efficiency of the pump.

Generally, pumps in the prior art use inlet pressure to drive the pistons into contact with the cam. However, due to design limitations inherent in such pumps, centrifugal boost pumps become necessary to produce the needed suction inlet pressure on the face of the pistons to produce the required acceleration to maintain piston contact with the retreating face of the swashplate cam.

However, in certain circumstances, such as when the pump is operated at high speeds, the centrifugal boost pump may not be cost effective. To reach the required operating speed, it is necessary to increase the angle of the swashplate, since the flow rate of the pump is a function of the cam's angle of the inclined swashplate. The suction feed pressure must be simultaneously increased to match the resulting increase in acceleration of the cam away from the piston. This resulting increase in the suction feed pressure needed to accelerate the piston to keep up with the cam and maintain constant contact reaches the point where it is no longer economically feasible to use a centrifugal boost pump to produce sufficient suction feed pressure.

One possible solution is to use a conventional helical compression spring in the pressure chamber of sufficient size and rate to furnish the piston with the needed acceleration at the beginning of the suction stoke. However, there are disadvantages to this solution. First, the, space required to install a helical compression spring will correspondingly increase the "dead space" that is present in the pressure chamber of the pump, tending to decrease the overall volumetric efficiency of the pump. Second, helical compression springs experience coil breakage caused by a variety of failure modes.

Another possible solution to furnish the piston with the needed acceleration at the beginning of the suction stroke would be to provide a direct mechanical connection between the piston and the camshaft which would result in the cam pulling the piston back on its suction stoke. However, this requires the addition of many more expensive parts, the performance of additional machining operations, and many more sliding surfaces to lubricate. The resulting pump would be more expensive to manufacture and less reliable to operate.

SUMMARY OF THE INVENTION

In accordance with the present invention, these and other problems are overcome with the provision of a swashplate pump comprising a pump housing having a fluid inlet and a fluid outlet, a plurality of cylinders each in communication with the fluid inlet and outlet, a piston reciprocally moveable in each cylinder to draw fluid into each cylinder during a suction stroke and to expel fluid under pressure from the fluid outlet during a pressure stroke, each piston having an upper pressure face at a first end and a piston head at a second end, and a rotating swashplate cam which engages the piston heads and imparts reciprocal movement to the pistons. To maintain a constant contact between each piston head and the swashplate cam, particularly during the suction stroke of each piston, the pump of the present invention also includes a magnetic spring circuit comprising a pair of permanent rare earth magnets associated with each piston, one magnet installed in the upper pressure face of the piston and the other installed directly opposite the first magnet in a part of the housing, with like poles of each magnet facing each other to produce a permanent levitating force against the piston. This magnetic spring force maintains the piston head of each piston in contact with the camming surface of the swashplate, thus eliminating the need for a helical compression spring or a centrifugal or other booster pump.

These and other objects and advantages of the present invention will be clarified in the following description of the preferred embodiment, with reference to the accompanying drawing.

DESCRIPTION OF THE DRAWINGS

FIG. 1 is a cross-sectional view of the a positive-displacement swashplate piston pump of the present invention.

DESCRIPTION OF THE PREFERRED EMBODIMENTS

In accordance with the present invention, a levitating magnetic piston spring circuit for use in a positive-displacement swashplate piston pump is described which provides distinct advantages when compared to the prior art. The invention can best be understood with reference to the accompanying figure.

Referring to FIG. 1, the positive-displacement swashplate piston pump of the present invention, indicated generally by reference number 10, is shown to comprise a pump housing 12 having a body 14 capped by a check valve housing 16, which in turn is capped by a gallery 18 which comprises a pump inlet port 22 and a pump outlet port 20. The bottom of the housing 12 is closed by a back plate 24, which is separated from the body 14 by a cam spacer 26. The aforementioned components are secured together by a plurality of bolts 28, only one of which is visible in FIG. 1.

The body 12 comprises a plurality, for example between five and twelve, of lined cylinders 30, only one of which is visible in FIG. 1. Within each cylinder 30 is positioned a piston 32, which is supported for reciprocal movement therein. Each piston 32 has an upper pressure face 34 at one end and piston head 36 at its opposite end. Each piston head 36 engages a cluster bearing 38 which is supported on an inclined cam surface 40 of a swashplate 42. The swashplate 42 is rotated via a drive shaft 44. As swashplate 42 rotates under the influence of shaft 44, the lower surface of cluster bearing 38 rides on the upper cam surface 40 of swashplate 42, imparting a vertical acceleration component to each piston 32.

Each cylinder 30 has associated therewith a pair of check valves 46, 48. Check valve 48 is mounted in check valve housing 16 above cylinder 30 and controls the flow of fluid from an inlet chamber 52 into cylinder 30. Check valve 46 is mounted in check valve housing 16 above cylinder 30 and controls the flow of fluid from cylinder 30 to an outlet chamber 50. Inlet chamber 52 is a ring-shaped bore formed in the gallery 18 in communication with the inlet port 22. Similarly, outlet chamber 50 is a ring-shaped bore formed in the gallery 18 in communication with outlet port 20.

Thus, as swashplate 42 rotates, each piston 32 is driven upward to expel pressurized fluid through outlet chamber 50 and outlet port 20. At the end of each pressure stroke, the piston head 36 of each piston 32 must remain in contact with cluster bearing 38 as the piston 32 is driven downward by the force of fluid entering cylinder 30 through inlet port 22 and inlet chamber 52.

To maintain constant contact between the piston head 36 of each piston 32 and the cluster bearing 38 during the suction stroke, the present invention employs a magnetic spring circuit comprising a pair of rare earth magnets which are installed with like poles facing each other to create a permanent levitating force between each piston 32 and the check valve housing 16. As seen in FIG. 1, the magnetic spring circuit comprises a first magnet 54 installed in the upper pressure face 34 of piston 32 and a second magnet 56 installed directly opposite first magnet 54 in the check valve housing 16. Magnets 54, 56 are installed with like poles facing each other to provide a magnetic repelling force on the upper pressure face 34 of piston 32. This downwardly directed magnetic force, as viewed in FIG. 1, creates a magnetic spring which accelerates the pistons during the suction stroke and maintains the piston head 36 in continual contact with cluster bearing 38 and, thus, the cam surface 40 of the swashplate 42.

As shown in FIG. 1, first magnet 54 may be mounted with its upper surface flush with the upper pressure face 34 of piston 32, while second magnet 56 may be mounted with its lower surface flush with the lower surface of check valve housing 16. Alternatively, one or the other of the first and second magnets 54, 56 may include a conical protuberance which is adapted to be received in a corresponding recess formed in the other magnet. In such an embodiment, the increased area of interaction between the two magnets can be expected to produce an increased repulsion force on the piston 32.

Although the foregoing detailed description of the present invention has been described by reference to various embodiments, and the best mode contemplated for carrying out the present invention has been herein shown and described, it will be understood that modifications or variations in the structure and arrangement of these embodiments other than those specifically set forth herein may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is intended to be limited only by the attached claims.

We claim:

1. A positive displacement pump comprising:

a pump housing having an inlet port and an outlet port;

a plurality of cylinders located in said housing in communication with said inlet and outlet ports;

valve means associated with each of said cylinders to control the flow of fluid between the inlet and outlet ports and the cylinder;

a piston reciprocally moveable in each of said cylinders, each piston having an upper pressure face at one end thereof and a piston head at a second end thereof;

a swashplate assembly having a cam surface which interacts with each said piston head;

wherein during rotation of said swashplate, said cam surface drives each said piston reciprocally in each said cylinder to force fluid under pressure to said outlet port;

magnet force generating means for urging each of said pistons into continuous contact with the cam surface during an inlet feed suction stroke of said piston.

2. The positive displacement pump according to claim 1, wherein said magnetic force generating means comprises a magnetic spring circuit associated with each piston.

3. The positive displacement pump of claim 2, wherein each said magnetic spring circuit comprises a pair of magnets, a first of said magnets installed in the upper pressure face of the piston and a second of said magnets installed in the pump housing adjacent the first magnet with like poles of each pair of magnets facing each other.

4. The positive displacement pump of claim 3, wherein each magnet comprises a permanent rare earth magnet.

5. The positive displacement pump of claim 3, wherein the first magnet has a face flush with the upper pressure face of the piston and the second magnet has a face flush with a surface of the housing forming a top of the cylinder.

6. The positive displacement pump of claim 3, wherein the second magnet includes a conical shaped protrusion extending toward the cylinder, and the first magnet includes a corresponding conical recess adapted to receive the conical protrusion when the upper pressure face of the piston approaches a position adjacent the top of the cylinder.

* * * * *